US007595737B2

(12) United States Patent
Fink et al.

(10) Patent No.: US 7,595,737 B2
(45) Date of Patent: Sep. 29, 2009

(54) SHEAR COUPLED ACOUSTIC TELEMETRY SYSTEM

(75) Inventors: Kevin D. Fink, Frisco, TX (US); Michael L. Fripp, Carrollton, TX (US); Adam D. Wright, Dallas, TX (US); John P. Rodgers, Trophy Club, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 448 days.

(21) Appl. No.: 11/459,397

(22) Filed: Jul. 24, 2006

(65) Prior Publication Data

US 2008/0030367 A1 Feb. 7, 2008

(51) Int. Cl.
*G01V 3/00* (2006.01)

(52) U.S. Cl. ..... 340/854.4; 367/82; 175/40

(58) Field of Classification Search ..... 367/81–83; 340/854.3, 854.4; 175/40
See application file for complete search history.

(56) References Cited

U.S. PATENT DOCUMENTS

| | | | |
|---|---|---|---|
| 3,905,010 | A | 9/1975 | Fitzpatrick |
| 4,283,780 | A | 8/1981 | Nardi |
| 4,293,936 | A | 10/1981 | Cox et al. |
| 4,302,826 | A | 11/1981 | Kent |
| 4,314,365 | A | 2/1982 | Petersen |
| 4,525,715 | A | 6/1985 | Smith |
| 4,562,559 | A | 12/1985 | Sharp et al. |
| 4,788,544 | A | 11/1988 | Howard |
| 4,839,644 | A | 6/1989 | Safinya |
| 5,128,901 | A | 7/1992 | Drumheller |
| 5,128,902 | A | 7/1992 | Spinnler |
| 5,130,706 | A | 7/1992 | Van Steenwyk |
| 5,148,408 | A | 9/1992 | Matthews |
| 5,160,925 | A | 11/1992 | Dailey et al. |
| 5,163,521 | A | 11/1992 | Pustanyk et al. |
| 5,222,049 | A | 6/1993 | Drumheller |
| 5,319,610 | A | 6/1994 | Airhart |
| 5,373,481 | A | 12/1994 | Orban |
| 5,448,227 | A | 9/1995 | Orban |
| 5,467,083 | A | 11/1995 | McDonald et al. |
| 5,477,505 | A | 12/1995 | Drumheller |
| 5,568,448 | A | 10/1996 | Taniguchi et al. |
| 5,576,703 | A | 11/1996 | MacLeod et al. |

(Continued)

FOREIGN PATENT DOCUMENTS

| | | |
|---|---|---|
| EP | 636763 | 7/1994 |

(Continued)

OTHER PUBLICATIONS

European Search Report issued for EP Patent Application No. 07252917.5 dated Nov. 13, 2007 (6 pages).

(Continued)

*Primary Examiner*—Albert K Wong
(74) *Attorney, Agent, or Firm*—Marlin R. Smith

(57) ABSTRACT

A shear coupled acoustic telemetry system. An acoustic telemetry system includes a tubular string having a pressure-bearing wall and an acoustic telemetry assembly positioned external to the wall and operative to communicate an acoustic signal between the assembly and the wall. The assembly may be shear coupled to the wall. The assembly may include a pressure-bearing housing positioned external to the wall.

33 Claims, 5 Drawing Sheets

U.S. PATENT DOCUMENTS

| | | | | |
|---|---|---|---|---|
| 5,592,438 | A | 1/1997 | Rorden | |
| 5,675,325 | A | 10/1997 | Taniguchi et al. | |
| 5,703,836 | A | 12/1997 | Drumheller | |
| 5,732,776 | A | 3/1998 | Tubel | |
| 5,831,549 | A | 11/1998 | Gearhart | |
| 5,914,911 | A | 6/1999 | Babour | |
| 5,924,499 | A * | 7/1999 | Birchak et al. | 175/40 |
| 5,941,307 | A | 8/1999 | Tubel | |
| 5,942,990 | A | 8/1999 | Smith et al. | |
| 6,018,301 | A | 1/2000 | Smith | |
| 6,018,501 | A | 1/2000 | Smith | |
| 6,028,534 | A | 2/2000 | Ciglenec et al. | |
| 6,075,462 | A | 6/2000 | Smith | |
| 6,108,268 | A | 8/2000 | Moss | |
| 6,114,972 | A | 9/2000 | Smith | |
| 6,137,747 | A | 10/2000 | Shah et al. | |
| 6,144,316 | A | 11/2000 | Skinner | |
| 6,160,492 | A | 12/2000 | Herman | |
| 6,177,882 | B1 | 1/2001 | Ringgenberg | |
| 6,188,222 | B1 | 2/2001 | Seydoux | |
| 6,192,988 | B1 | 2/2001 | Tubel | |
| 6,234,257 | B1 | 5/2001 | Ciglenec et al. | |
| 6,272,916 | B1 | 8/2001 | Taniguchi et al. | |
| 6,308,562 | B1 | 10/2001 | Abdallah et al. | |
| 6,320,820 | B1 | 11/2001 | Gardner et al. | |
| 6,370,082 | B1 | 4/2002 | Gardner et al. | |
| 6,392,561 | B1 | 5/2002 | Davies et al. | |
| 6,434,084 | B1 | 8/2002 | Schultz | |
| 6,442,105 | B1 | 8/2002 | Tubel | |
| 6,443,228 | B1 | 9/2002 | Aronstam et al. | |
| 6,450,258 | B2 | 9/2002 | Green | |
| 6,462,672 | B1 | 10/2002 | Besson | |
| 6,464,011 | B2 | 10/2002 | Tubel | |
| 6,464,021 | B1 | 10/2002 | Edwards | |
| 6,469,635 | B1 | 10/2002 | Hudson | |
| 6,470,996 | B1 | 10/2002 | Kyle | |
| 6,552,665 | B1 | 4/2003 | Miyamae | |
| 6,577,244 | B1 | 6/2003 | Clark | |
| 6,583,729 | B1 | 6/2003 | Gardner et al. | |
| 6,614,360 | B1 * | 9/2003 | Leggett et al. | 340/853.1 |
| 6,626,248 | B1 | 9/2003 | Roberts | |
| 6,633,236 | B2 | 10/2003 | Vinegar et al. | |
| 6,657,597 | B2 | 12/2003 | Rodney et al. | |
| 6,691,779 | B1 | 2/2004 | Sezginer | |
| 6,697,298 | B1 | 2/2004 | Dubinsky et al. | |
| 6,745,833 | B2 | 6/2004 | Aronstam et al. | |
| 6,757,218 | B2 | 6/2004 | Dubinsky | |
| 6,768,700 | B2 | 7/2004 | Veneruso | |
| 6,781,520 | B1 | 8/2004 | Smith et al. | |
| 6,781,521 | B1 | 8/2004 | Gardner et al. | |
| 6,784,599 | B1 | 8/2004 | Stoecklein et al. | |
| 6,801,136 | B1 | 10/2004 | Goodman et al. | |
| 6,819,260 | B2 | 11/2004 | Gardner et al. | |
| 6,843,120 | B2 | 1/2005 | Standen | |
| 6,847,585 | B2 | 1/2005 | Macpherson | |
| 6,899,178 | B2 | 5/2005 | Tubel | |
| 6,912,177 | B2 | 6/2005 | Smith | |
| 7,080,699 | B2 | 7/2006 | Lovell et al. | |
| 7,084,782 | B2 | 8/2006 | Davies et al. | |
| 7,257,050 | B2 * | 8/2007 | Stewart et al. | 367/82 |
| 2002/0043369 | A1 | 4/2002 | Vinegar | |
| 2002/0167418 | A1 | 11/2002 | Goswami | |
| 2003/0010495 | A1 | 1/2003 | Mendez | |
| 2003/0026167 | A1 | 2/2003 | Hahn | |
| 2003/0072218 | A1 | 4/2003 | Smith | |
| 2003/0151977 | A1 | 8/2003 | Shah | |
| 2003/0192692 | A1 | 10/2003 | Tubel | |
| 2004/0004553 | A1 | 1/2004 | Rodney | |
| 2004/0020643 | A1 | 2/2004 | Thomeer | |
| 2004/0035608 | A1 | 2/2004 | Meehan | |
| 2004/0047235 | A1 | 3/2004 | Kyle | |
| 2004/0105342 | A1 | 6/2004 | Gardner | |
| 2004/0200613 | A1 * | 10/2004 | Fripp et al. | 166/250.01 |
| 2004/0202047 | A1 | 10/2004 | Fripp | |
| 2004/0204856 | A1 | 10/2004 | Jenkins | |
| 2004/0246141 | A1 | 12/2004 | Tubel | |
| 2004/0263350 | A1 | 12/2004 | Vinegar | |
| 2005/0024232 | A1 | 2/2005 | Gardner | |
| 2005/0046588 | A1 | 3/2005 | Wisler | |
| 2005/0056419 | A1 | 3/2005 | Hosie | |
| 2005/0167098 | A1 | 8/2005 | Lovell et al. | |
| 2005/0168349 | A1 | 8/2005 | Huang et al. | |
| 2005/0194182 | A1 | 9/2005 | Rodney | |
| 2006/0090893 | A1 | 5/2006 | Sheffield | |
| 2006/0220650 | A1 | 10/2006 | Lovell et al. | |
| 2006/0233048 | A1 | 10/2006 | Froelich et al. | |
| 2008/0137481 | A1 | 6/2008 | Shah et al. | |

FOREIGN PATENT DOCUMENTS

| | | |
|---|---|---|
| EP | 0773345 | 5/1997 |
| EP | 08822871 | 12/1998 |
| EP | 932054 | 7/1999 |
| EP | 1467060 | 10/2004 |
| EP | 1662673 | 5/2006 |
| GB | 2247477 | 3/1992 |
| GB | 2340520 | 2/2000 |
| GB | 2370144 | 6/2002 |
| GB | 2410512 | 8/2005 |
| GB | 2416463 | 1/2006 |
| RU | 2190097 | 9/2002 |
| RU | 2194161 | 12/2002 |
| RU | 2215142 | 10/2003 |
| RU | 2229733 | 5/2004 |
| WO | 9962204 | 12/1999 |
| WO | WO0212676 | 2/2002 |
| WO | 03/067029 | 8/2003 |
| WO | 2006019935 | 2/2006 |

OTHER PUBLICATIONS

Office Action dated Jul. 21, 2008, for U.S. Appl. No. 11/459,398 (33 pages).

European Search Report issued for EP Patent Application No. 07252925.8 dated Sep. 28, 2007 (7 pages).

Morgan Electro Ceramics, Technical Publication TP-220—Piezoelectric Transducer Materials—Stress. "Effects of High Static Stress on the Piezoelectric Properties of Transducer Materials." undated, pp. 1-6.

Office Action issued Oct. 3, 2008, for U.S. Appl. No. 11/459,402, 27 pages.

American Institute of Aeronautics and Astronautics paper AIAA-99-1320, dated 1999.

Halliburton, "Sunrise Telemetry System" product brochure, dated 2004.

* cited by examiner

SHEAR COUPLED ACOUSTIC TELEMETRY SYSTEM

BACKGROUND

The present invention relates generally to equipment utilized and operations performed in conjunction with wireless telemetry and, in an embodiment described herein, more particularly provides a shear coupled acoustic telemetry system for use with a subterranean well.

Typical acoustic telemetry systems used in subterranean wells include at least one stack of piezoceramic elements, or other electromagnetically active elements (piezoelectrics, magnetostrictives, electrostrictives, voice coil, etc.) to generate axial stress waves in a wall of a tubular string. This due to the fact that it is generally considered that axial stress waves are less attenuated as compared to other types of stress waves (torsional, flexural, surface, etc.) in a tubular string positioned in a wellbore environment.

Thus, past acoustic telemetry systems have tended to use transmitters which are axially inline with the tubular string wall for most efficient axial coupling between the transmitter and the wall. To maximize the volume of the electromagnetically active elements, the transmitter is usually positioned in an annular cavity internal to the tubular string wall, with annular-shaped elements axially inline with the wall and concentric with the tubular string.

However, such configurations pose certain problems. For example, tubular strings used in wellbores typically have very limited thickness in their walls, providing only limited available volume for acoustic transmitters. As another example, each different size of tubular string requires that a different-sized transmitter be designed specifically for that tubular string, which eliminates any possibility of interchangeability between transmitters and tubular strings. Furthermore, axially coupled transmitters are not well suited for taking advantage of other modes of transmission (such as flexural, torsional, shear, etc.) or multi-mode combinations, which may be more advantageous for short distance acoustic transmission.

SUMMARY

In carrying out the principles of the present invention, an acoustic telemetry system is provided which solves at least one problem in the art. One example is described below in which the system utilizes shear coupling to transmit acoustic signals from a transmitter to a wall of a tubular string. Another example is described below in which the transmitter is contained within its own pressure-bearing housing which is positioned external to the tubular string wall.

In one aspect of the invention, an acoustic telemetry system is provided which includes a tubular string having a pressure-bearing wall, and an acoustic signal transmitter. The transmitter is positioned external to the wall, and is operative to transmit an acoustic signal to the wall. The transmitter may be positioned external to the wall without necessarily being external to the tubular string itself.

In another aspect of the invention, an acoustic telemetry system includes an acoustic signal transmitter shear coupled to a pressure-bearing wall of a tubular string, with the transmitter being operative to transmit an acoustic signal to the wall. The shear coupling (transmission of shear force between surfaces) may be enhanced by use of clamps, adhesive bonding, roughened or serrated surfaces, magnets, fasteners, etc.

In yet another aspect of the invention, an acoustic telemetry system includes an acoustic signal transmitter contained within a pressure-bearing housing positioned external to a pressure-bearing wall of a tubular string and operative to transmit an acoustic signal to the wall. The transmitter housing may be shear coupled to the tubular string wall.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
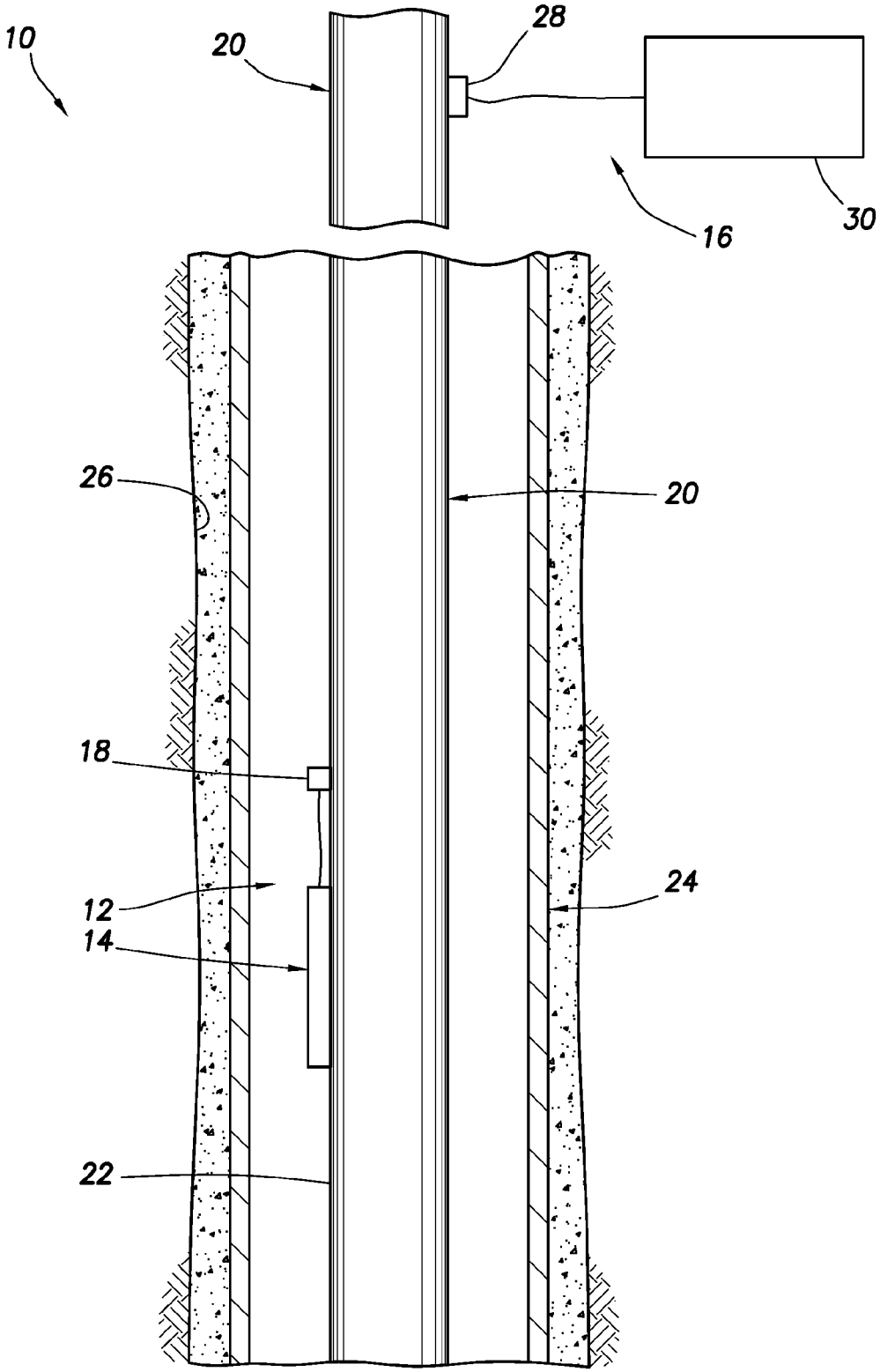
FIG. 1 is a schematic partially cross-sectional view of a well system embodying principles of the present invention.

Representatively illustrated in FIG. 1 is a well system 10 which embodies principles of the present invention. The well system 10 includes an acoustic telemetry system 12 for communicating data and/or control signals between downhole and surface locations.

The telemetry system 12 includes a downhole transmitter assembly 14 and a surface receiver assembly 16. However, it should be clearly understood that the transmitter assembly 14 may also include a receiver, and the receiver assembly 16 may also include a transmitter, so that either one of these is in effect a transceiver.

Furthermore, the telemetry system 12 could include other or different components not illustrated in FIG. 1, such as one or more repeaters for relaying signals between the transmitter assembly 14 and the receiver assembly 16, etc. Either or both of the transmitter assembly 14 and receiver assembly 16 may be incorporated into other components, such as a repeater, another type of well tool, etc.

The transmitter assembly 14 is preferably connected to a downhole device 18. The connection between the device 18 and the transmitter assembly 14 may be hardwired as depicted in FIG. 1, or it may be wireless.

The device 18 may be, for example, a sensor for sensing a downhole parameter (such as temperature, pressure, water cut, resistivity, capacitance, radioactivity, acceleration, displacement, etc.), an actuator for a well tool, or any other type of device for which data and/or control signals would be useful for communication with the receiver assembly 16. The device 18 may be incorporated into the transmitter assembly 14.

A tubular string 20 extends between the transmitter assembly 14 and the receiver assembly 16. The telemetry system 12 provides for communication between the transmitter and receiver assemblies 14, 16 by transmission of stress waves through a pressure-bearing wall 22 of the tubular string 20.

Although the tubular string 20 is depicted in FIG. 1 as being a tubing string positioned within an outer casing or liner string 24, this example is provided only for illustration purposes, and it should be clearly understood that many other configurations are possible in keeping with the principles of the invention. For example, the tubular string 20 could instead be a casing or liner string, which may or not be cemented in a wellbore 26 of the well system 10. As another alternative, the tubular string 20 could be positioned in an open, rather than a cased, wellbore.

Figure 4:
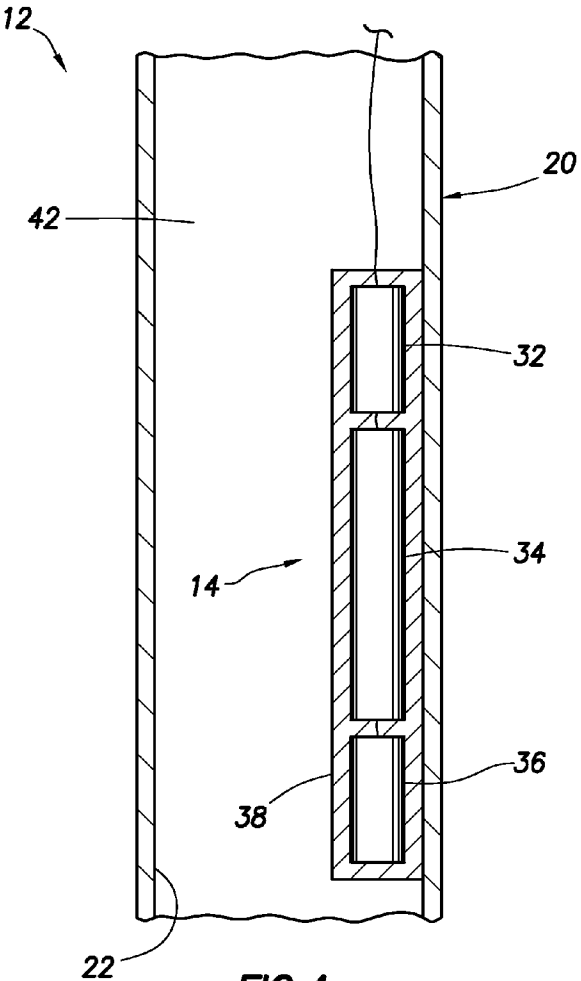
FIG. 4 is an enlarged scale schematic cross-sectional view of an alternate configuration of the downhole transmitter portion of the acoustic telemetry system.

Although the transmitter assembly 14 and downhole device 18 are depicted in FIG. 1 as being positioned external to the tubular string 20, other configurations are possible in keeping with the principles of the invention. For example, the transmitter assembly 14 and/or the device 18 could be internal to the tubular string 20 (such as, positioned in an internal flow passage 42 of the tubular string as illustrated in FIG. 4), the device could be positioned within the wall 22 of the tubular string, etc.

The receiver assembly 16 is preferably positioned at a surface location, but other locations are possible in keeping with the principles of the invention. For example, if the receiver assembly 16 is incorporated into a repeater or other type of well tool, then the receiver assembly may be positioned downhole, in a subsea wellhead, internal or external to the tubular string 20 (as described herein for the transmitter assembly 14), etc.

The receiver assembly 16 as depicted in FIG. 1 includes an acoustic signal detector 28 (such as an accelerometer or other sensor, e.g., including a piezoceramic or other electromagnetically active elements, etc.) and electronic circuitry 30 for receiving, recording, processing, interpreting, displaying, and otherwise dealing with the received acoustic signals. These components are well known in the art and are not further described herein.

Figure 2:
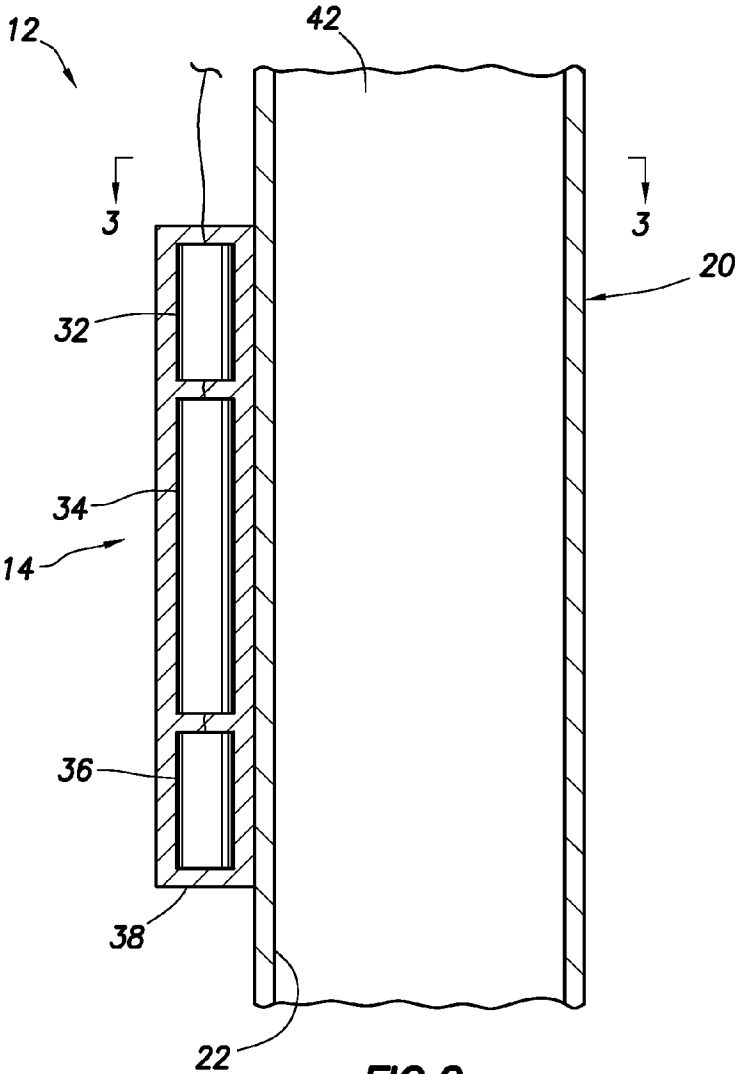
FIG. 2 is an enlarged scale schematic cross-sectional view of a configuration of a downhole transmitter portion of an acoustic telemetry system in the well system of FIG. 1.

Referring additionally now to FIG. 2, an enlarged scale view of the downhole portion of the telemetry system 12 is representatively illustrated. In this view it may be clearly seen that the transmitter assembly 14 is positioned external to the pressure-bearing wall 22 of the tubular string 20. The transmitter assembly 14 is not axially inline with any portion of the wall 22, and is not received in any recess or cavity formed in the wall.

Instead, the transmitter assembly 14 is shear coupled to the wall 22, as described more fully below. This unique positioning of the transmitter assembly 14 provides many advantages. For example, the transmitter assembly 14 is not limited to the available cross-sectional area of the wall 22, the transmitter assembly can be used with various sizes of tubular strings, the transmitter assembly can effectively transmit acoustic signal modes other than axial (such as flexural, which is particularly useful for short distance communication), etc.

As depicted in FIG. 2, the transmitter assembly 14 includes electronic circuitry 32, an acoustic transmitter 34 and a power source 36 (such as a battery or downhole generator, etc.). These components are preferably (but not necessarily) contained within a pressure-bearing housing 38 which is attached to the wall 22 of the tubular string 20.

The electronic circuitry 32 is used for communicating with the device 18 and operating the transmitter 34. The power source 36 is used for supplying electrical power to operate the circuitry 32 and the transmitter 34.

The acoustic transmitter 34 is preferably of the type which includes a stack of piezoceramic or other electromagnetically active elements, as described more fully below. Note that the transmitter 34 is external to the wall 22 of the tubular string 20, and is not concentric with the tubular string.

Figure 3:
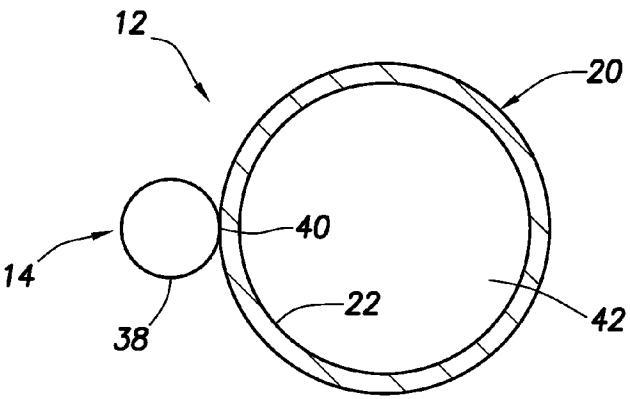
FIG. 3 is a schematic cross-sectional view of the configuration of the downhole transmitter portion of the acoustic telemetry system, taken along line 3-3 of FIG. 2.

Referring additionally now to FIG. 3, another cross-sectional view of the downhole portion of the telemetry system 12 is representatively illustrated. In this view it may be seen that the contact between the housing 38 and the wall 22 of the tubular string 20 is only at a single point 40 in transverse cross-section. However, the housing 38 and/or wall 22 could be otherwise configured to provide a larger contact surface area for shear coupling therebetween.

In this view it may again be seen that the transmitter assembly 14 is external to both the wall 22 and an internal flow passage 42 of the tubular string 20. The transmitter assembly 14 could, however, be positioned within the flow passage 42 and remain external to the wall 22.

We can also see from this view that there is a reduced contact area between the transmitter assembly 14 and the wall 22. Acoustic energy travels from the transmitter assembly 14 to the wall 22 through this reduced contact area.

As used herein, the term "reduced contact area" is used to indicate a line contact or a point contact. A line contact is contact between surfaces wherein a ratio of length to width of the contact is greater than or equal to four. A point contact exists when the area of the contact is less than or equal to half of the total cross-sectional area (taken transverse to the longitudinal axis) of the smaller component, in this case the housing 38 of the transmitter assembly 14.

Referring additionally now to FIG. 4, an alternate configuration of the downhole portion of the telemetry system 12 is representatively illustrated. In this configuration, the transmitter assembly 14 is positioned within the passage 42, but is still external to the wall 22 of the tubular string 20, since the transmitter is not axially inline with the wall, is not positioned in a cavity in the wall, etc. Instead, the housing 38 is attached and shear coupled to an inner surface of the wall 22.

Figure 5:
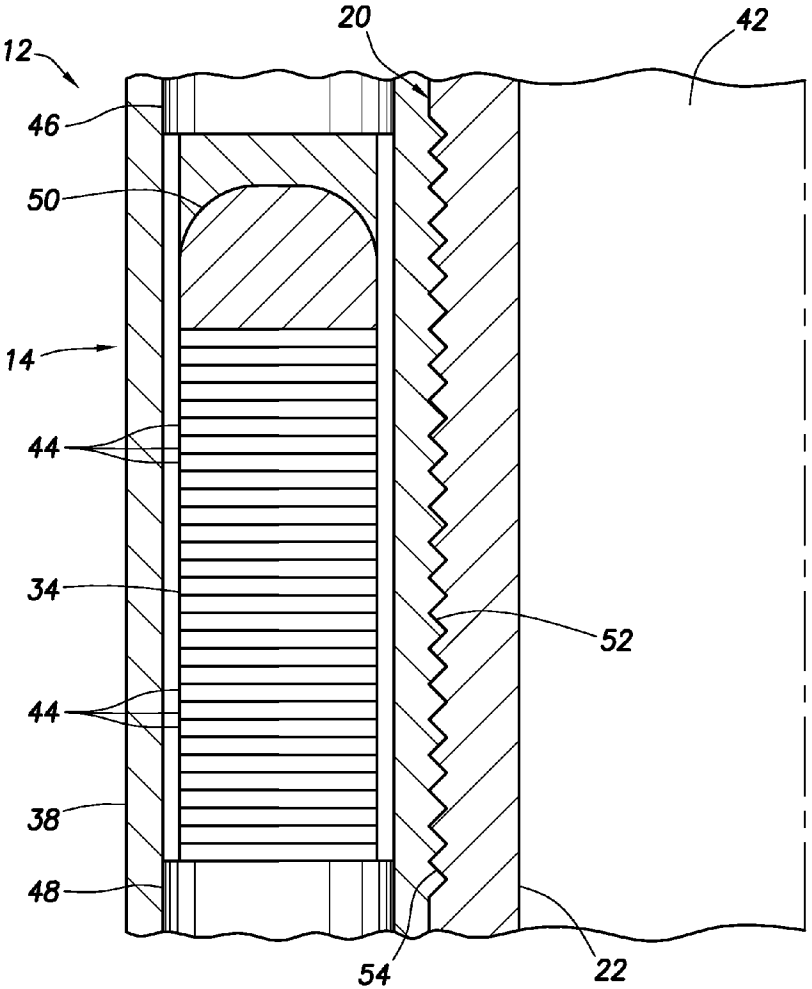
FIG. 5 is a further enlarged scale schematic cross-sectional view of the downhole transmitter portion of the acoustic telemetry system.

Referring additionally now to FIG. 5, a further enlarged and more detailed cross-sectional view of the transmitter assembly 14 is representatively illustrated. In this view it may be seen that the transmitter 34 includes a stack of electromagnetically active disc-shaped elements 44 within the housing 38. A compressive preload is applied to the elements 44 by nuts 46, 48 or another preload biasing device. However, it should be understood that it is not necessary to apply a preload to the elements 44 in keeping with the principles of the invention.

Preferably, a spherical load transfer device 50 is used between the elements 44 and one or both of the preload nuts 46, 48. The construction and advantages of the load transfer device 50 are more fully described in U.S. application Ser. No. 11/459,398, filed Jul. 24, 2006, and the entire disclosure of which is incorporated herein by this reference. The transmitter 34 may also utilize the thermal expansion matching and acoustic impedance matching techniques described in the incorporated application.

To enhance the shear coupling between the housing 38 and the wall 22 of the tubular string 20, external mating surfaces 52, 54 of the housing and wall may be roughened, serrated, etc. to provide increased "grip" therebetween. This enhanced shear coupling may be provided in addition to attachment of the housing 38 to the wall 22 using adhesive bonding, fasteners, clamps, etc.

Figure 6:
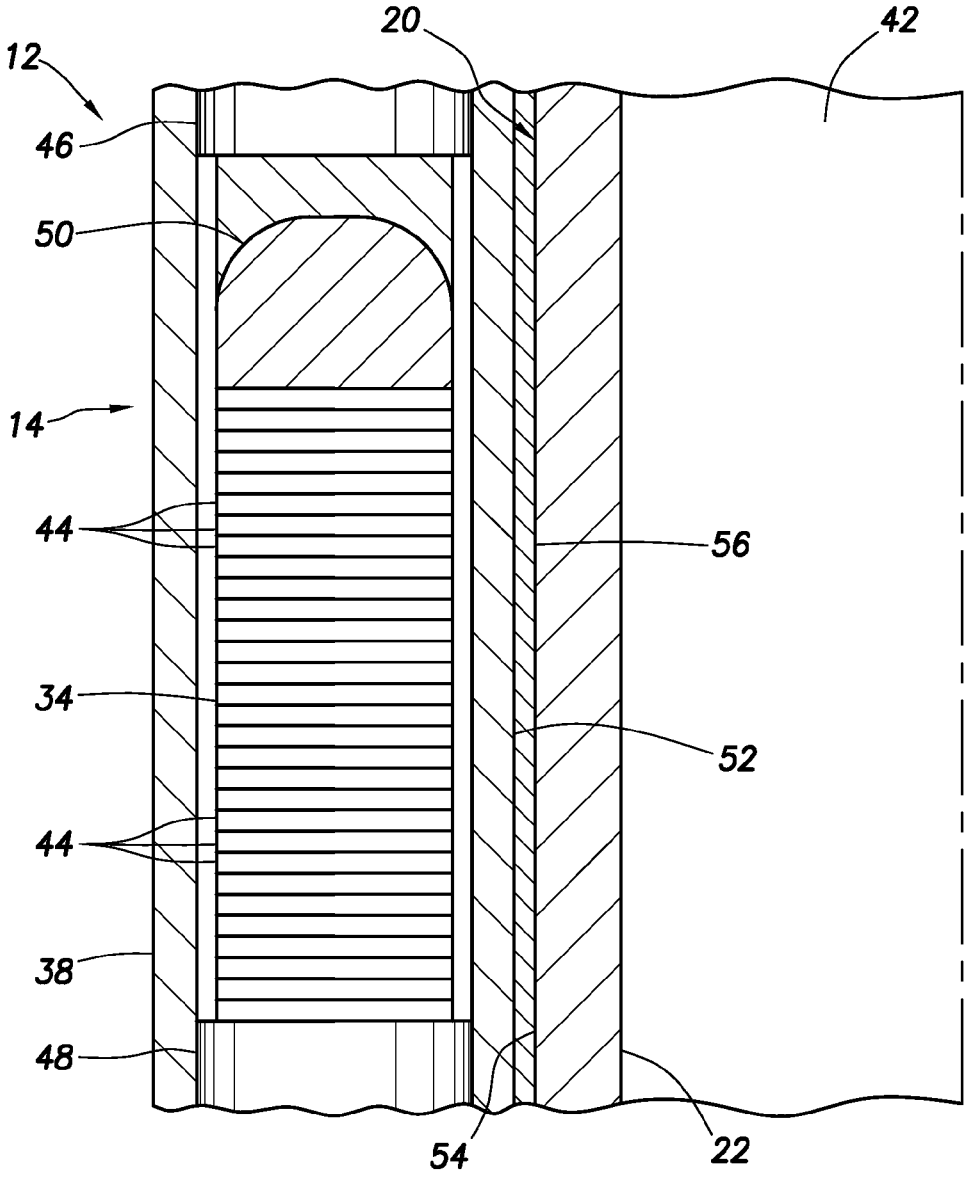
FIG. 6 is a schematic partially cross-sectional view of a first alternate construction of the downhole transmitter portion of the acoustic telemetry system.

Referring additionally now to FIG. 6, another alternate configuration of the downhole portion of the telemetry system 12 is representatively illustrated. In this configuration, an electrically insulating layer 56 is positioned between the mating surfaces 52, 54 of the housing 38 and wall 22. The layer 56 isolates the transmitter assembly 14 from spurious electrical currents which may be produced in the tubular string 20 due to various phenomena.

Electrically insulating layers may also be used within the transmitter assembly 14 itself, either in addition or as an alternative to the layer 56. For example, the elements 34 could be isolated from the housing 38 using an insulating layer within the housing.

It should be understood, however, that there could be metal-to-metal contact between the housing 38 and the wall 22, if desired. For example, in the configuration depicted in FIG. 5, it may be desirable for there to be metal-to-metal contact between the surfaces 52, 54. Of course, an electrically insulating layer could be used between the surfaces 52, 54 in the configuration of FIG. 5, if desired.

Figure 7:
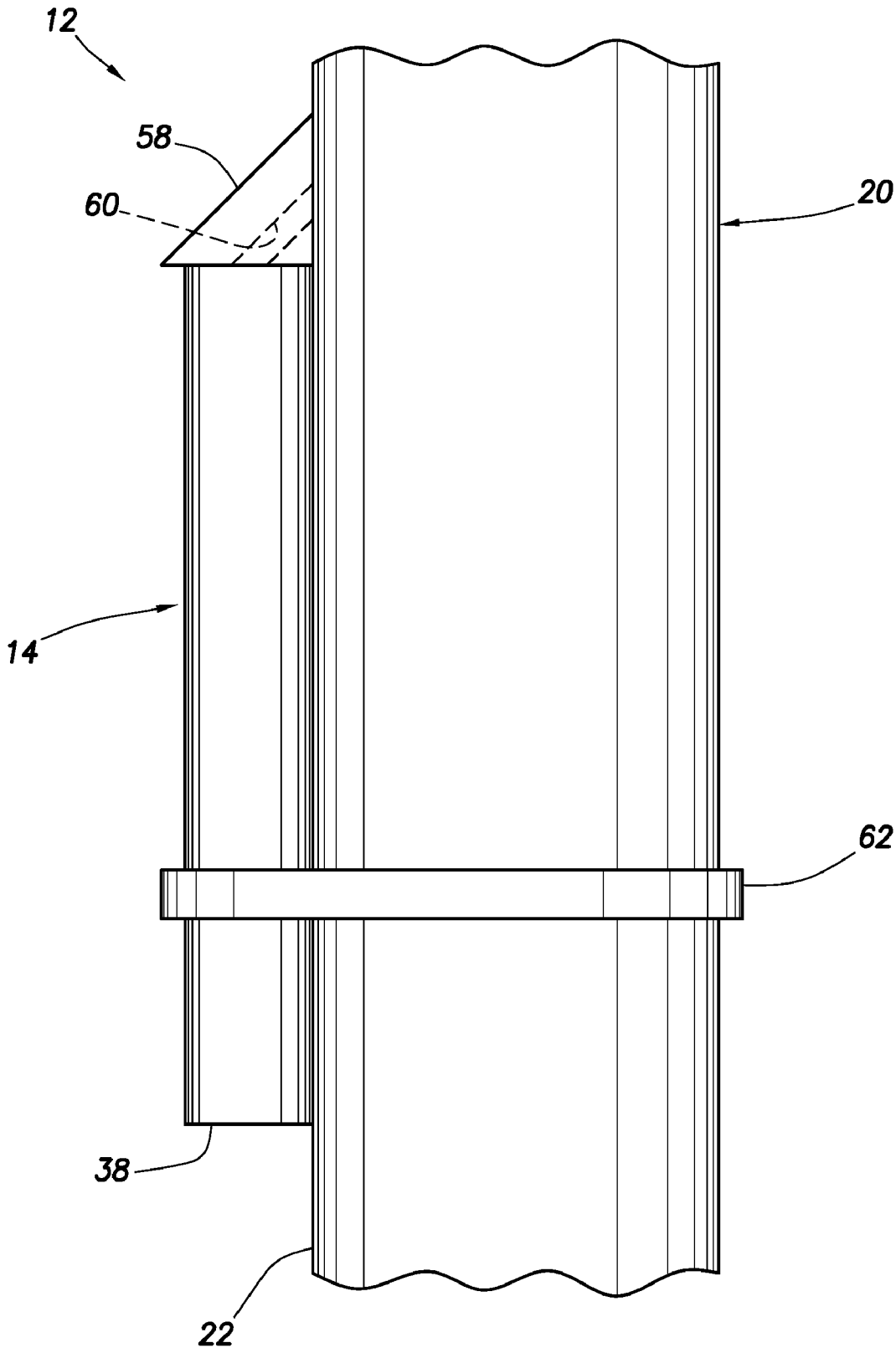
FIG. 7 is a schematic elevational view of a second alternate construction of the downhole transmitter portion of the acoustic telemetry system.

Referring additionally now to FIG. 7, another alternate configuration of the downhole portion of the telemetry system 12 is representatively illustrated. In this alternate configuration, an inclined structure 58 is provided at an upper end of the transmitter assembly 14. A similar structure may be provided at the lower end of the transmitter assembly 14 in addition, or as an alternative, to the structure 58.

The structure 58 may perform any of several functions. For example, the structure 58 may protect the transmitter assembly 14 from damage during conveyance in the wellbore 26, the structure may provide a passage 60 for pressure or wired communication with the device 18, the flow passage 42, etc., and may in some embodiments provide some axial acoustic transmission to the wall 22 of the tubular string 20.

However, preferably the main acoustic coupling between the housing 38 and the wall 22 of the tubular string 20 is via shear coupling. Depicted in FIG. 7 is another manner of ensuring shear force transmission between the housing 38 and the wall 22 in the form of a band clamp 62 which encircles the housing and wall. The clamp 62 applies a normal force between the surfaces 52, 54 to thereby enhance the frictional shear coupling therebetween. Note that any manner of applying a normal force between the surfaces 52, 54 or otherwise increasing shear coupling between the surfaces may be used in keeping with the principles of the invention.

It may now be fully appreciated that the acoustic telemetry system 12 described above provides a variety of benefits, including cost-effective and convenient use of the transmitter 34 with various sizes of tubular strings, ability to effectively transmit acoustic stress waves other than or in addition to axial (such as flexural, surface, torsional, multi-mode, etc.), modular construction, volume unlimited by tubular string wall, etc. The transmitter 34 is advantageously not concentric with the tubular string 20, but is instead positioned external to the wall 22 of the tubular string.

As discussed above, the transmitter assembly 14 could include a receiver, so that the transmitter assembly could alternatively be described as a transceiver. In that case, the elements 44 (or other electromagnetically active elements, other types of sensors, etc.) could be used to receive or otherwise sense stress waves transmitted through the tubular string 20 from another location. In this manner, signals could be either transmitted to or from the transmitter assembly 14. The term "acoustic telemetry assembly" is used herein to indicate a transmitter assembly (such as the transmitter assembly 14), a receiver assembly (such as the receiver assembly 16) or a combination thereof.

Although several specific embodiments of the invention have been separately described above, it should be clearly understood that any, or any combination, of the features of any of these embodiments may be incorporated into any of the other embodiments in keeping with the principles of the invention.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. An acoustic telemetry system, comprising:

a tubular string having a pressure-bearing wall;

an acoustic signal transmitter positioned external to the wall and operative to transmit an acoustic signal to the wall; and an electrically insulating layer which isolates the acoustic signal transmitter from spurious electrical current in the tubular string.

2. The telemetry system of claim 1, wherein the transmitter is shear coupled to the wall.

3. The telemetry system of claim 1, wherein the transmitter is contained within a pressure-bearing housing, which is positioned external to the wall.

4. The telemetry system of claim 3, wherein the housing is shear coupled to the wall.

5. The telemetry system of claim 3, wherein the electrically insulating layer is positioned between the housing and the wall.

6. The telemetry system of claim 1, wherein the transmitter is positioned within an internal flow passage of the tubular string.

7. The telemetry system of claim 1, wherein the tubular string is positioned within a wellbore of a well.

8. The telemetry system of claim 1, wherein the transmitter is acoustically coupled to the wall with a reduced contact area.

9. An acoustic telemetry system, comprising:

a tubular string having a pressure-bearing wall;

an acoustic telemetry assembly shear coupled to the wall and operative to communicate an acoustic signal between the assembly and the wall; and an electrically insulating layer which isolates the acoustic telemetry assembly from spurious electrical current in the tubular string.

10. The telemetry system of claim 9, wherein the assembly is external to the wall.

11. The telemetry system of claim 9, wherein the assembly includes a pressure-bearing housing, which is positioned external to the wall.

12. The telemetry system of claim 11, wherein the housing is shear coupled to the wall.

13. The telemetry system of claim 11, wherein the electrically insulating layer is positioned between the housing and the wall.

14. The telemetry system of claim 11, wherein the electrically insulating layer is positioned within the housing.

15. The telemetry system of claim 11, wherein there is metal-to-metal contact between the housing and the wall.

16. The telemetry system of claim 9, wherein the assembly is positioned within an internal flow passage of the tubular string.

17. The telemetry system of claim 9, wherein the tubular string is positioned within a wellbore of a well.

18. The telemetry system of claim 9, wherein the assembly includes an acoustic transmitter.

19. The telemetry system of claim 9, wherein the assembly includes an acoustic receiver.

20. An acoustic telemetry system, comprising:

a tubular string having a pressure-bearing wall;

an acoustic signal transmitter contained within a pressure-bearing housing positioned external to the wall and operative to transmit an acoustic signal to the wall; and an electrically insulating layer which isolates the acoustic signal transmitter from spurious electrical current in the tubular string.

21. The telemetry system of claim 20, wherein the housing is shear coupled to the wall.

22. The telemetry system of claim 20, further comprising an electrically insulating layer positioned between the housing and the wall.

23. The telemetry system of claim 20, wherein the housing is positioned within an internal flow passage of the tubular string.

24. The telemetry system of claim 20, wherein the tubular string is positioned within a wellbore of a well.

25. The telemetry system of claim 20, wherein the housing is positioned within a wellbore of a well.

26. An acoustic telemetry system, comprising:

a tubular string having a pressure-bearing wall;

an acoustic telemetry assembly including a pressure-bearing housing positioned external to the wall and operative for communicating an acoustic signal between the housing and the wall, and there being a reduced contact area between the housing and the wall; and an electrically insulating layer which isolates the acoustic telemetry assembly from spurious electrical current in the tubular string.

27. The telemetry system of claim 26, wherein the housing is shear coupled to the wall.

28. The telemetry system of claim 26, wherein the electrically insulating layer is positioned between the housing and the wall.

29. The telemetry system of claim 26, wherein the housing is positioned within an internal flow passage of the tubular string.

30. The telemetry system of claim 26, wherein the tubular string is positioned within a wellbore of a well.

31. The telemetry system of claim 26, wherein the housing is positioned within a wellbore of a well.

32. The telemetry system of claim 26, wherein the assembly includes an acoustic transmitter.

33. The telemetry system of claim 26, wherein the assembly includes an acoustic receiver.

* * * * *

UNITED STATES PATENT AND TRADEMARK OFFICE

CERTIFICATE OF CORRECTION

PATENT NO. : 7,595,737 B2
APPLICATION NO. : 11/459397
DATED : September 29, 2009
INVENTOR(S) : Fink et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 515 days.

Signed and Sealed this

Twenty-eighth Day of September, 2010

David J. Kappos

David J. Kappos
*Director of the United States Patent and Trademark Office*